US009803405B2

(12) United States Patent
Zetti

(10) Patent No.: US 9,803,405 B2
(45) Date of Patent: Oct. 31, 2017

(54) ADJUSTABLE SNAP-ACTING HINGE

(71) Applicant: D.G.N. S.R.L., Modena (IT)

(72) Inventor: Daniele Zetti, Modena (IT)

(73) Assignee: D.G.N. S.R.L., Modena (IT)

( * ) Notice: Subject to any disclaimer, the term of this patent is extended or adjusted under 35 U.S.C. 154(b) by 0 days.

(21) Appl. No.: 14/173,679

(22) Filed: Feb. 5, 2014

(65) Prior Publication Data

US 2014/0215761 A1 Aug. 7, 2014

(30) Foreign Application Priority Data

Feb. 5, 2013 (IT) ..... MO2013A0025

(51) Int. Cl.

| | |
|---|---|
| ***E05F 1/08*** | (2006.01) |
| ***E05F 1/12*** | (2006.01) |
| ***E05D 7/04*** | (2006.01) |
| ***E05D 3/16*** | (2006.01) |

(52) U.S. Cl.

CPC ..... *E05D 7/0407* (2013.01); *E05D 3/16* (2013.01); *E05F 1/1261* (2013.01); *E05D 7/04* (2013.01); *E05D 2003/163* (2013.01); *E05Y 2201/25* (2013.01); *E05Y 2201/412* (2013.01); *E05Y 2900/20* (2013.01); *Y10T 16/53833* (2015.01)

(58) Field of Classification Search

CPC ..... E05D 11/06; E05D 11/10; E05D 11/1021; E05D 3/16; E05D 5/006; E05D 5/00; E05D 5/027; E05F 1/1246; E05F 1/1253

See application file for complete search history.

(56) References Cited

U.S. PATENT DOCUMENTS

| | | | | |
|---|---|---|---|---|
| 4,724,578 | A * | 2/1988 | Toyama | 16/240 |
| 5,035,026 | A * | 7/1991 | Carlo et al. | 16/288 |
| 2003/0159249 | A1* | 8/2003 | Tsung-Lung | 16/371 |
| 2006/0156513 | A1* | 7/2006 | Zetti | 16/288 |
| 2008/0238276 | A1* | 10/2008 | Migli | 312/326 |
| 2014/0215761 | A1* | 8/2014 | Zetti | 16/288 |

FOREIGN PATENT DOCUMENTS

| | | | |
|---|---|---|---|
| EP | 0952290 | A2 | 10/1999 |
| EP | 0994229 | A2 | 4/2000 |
| EP | 1653029 | A2 | 5/2006 |
| EP | 2615234 | A1 | 7/2013 |

OTHER PUBLICATIONS

Italian Search Report, Italian Application No. MO2013/A000025, dated Aug. 27, 2013.

* cited by examiner

*Primary Examiner* — Emily Morgan
(74) *Attorney, Agent, or Firm* — Brooks Kushman P.C.

(57) ABSTRACT

An adjustable snap-acting hinge is provided. The hinge includes a first articulated quadrilateral and a second articulated quadrilateral, which can move on a working plane and share a first lever and a second lever and are provided respectively with a plate for coupling to a first element and with a plate for fixing to a second element. A contrast element is associated with the coupling plate and can be arranged in at least one position for use, which lies between a first position in which the contrast element is arranged at a maximum distance from the point of the first lever, and a second position in which the contrast element is arranged at a minimum distance from the point of the first lever. The hinge also includes locking means for keeping the contrast element in the position for use.

16 Claims, 8 Drawing Sheets

ADJUSTABLE SNAP-ACTING HINGE

CROSS-REFERENCE TO RELATED APPLICATIONS

This application claims priority to Italian Patent Application No. MO2013A000025 filed Feb. 5, 2013, the disclosure of which is incorporated in its entirety by reference herein.

TECHNICAL FIELD

The present invention relates to an adjustable snap-acting hinge.

BACKGROUND

In the field of furniture, the use is known of snap-acting hinges that are adapted to allow the rotation of a closure element about a hinge axis that is substantially horizontal or inclined, such as, for example, those used for opening and closing door leaves on cabinets arranged inside caravans or the like. Such snap-acting hinges comprise two articulated quadrilaterals and are provided with elastic means that are suitably arranged and dimensioned, as described in EP1653029 (in the name of the same inventor as the present application), for keeping the door leaf in the stable closed position in order to prevent its accidental opening during the movement of the caravan and for locking it temporarily in the stable open position, thus preventing the door leaf from automatically returning to the closed position due to its own weight force and colliding, during such movement, with the user.

Such conventional hinges are not devoid of drawbacks including the fact that they require a suitable dimensioning of the elastic means for moving door leaves with different weights. In fact, in caravans, or the like, all the available space is optimized, by seeking to make small containment compartments even in restricted spaces which, necessarily, must be temporarily closed by a corresponding door leaf. Inside the caravan there are therefore door leaves of different sizes and structures with different weights which, if supported when open by hinges provided with the same elastic means, have a different opening angle or a different opening/closing movement. In order to standardize the opening angle or the opening/closing movement for the different door leaves, it is necessary to have elastic means that are suitably dimensioned according to the weight of the door leaf to be supported, thus increasing the production costs and the complexity of managing different components for makers and of the variety of hinges for users.

SUMMARY

The aim of the present invention consists in providing an adjustable snap-acting hinge that eliminates the drawbacks and overcomes the limitations of the known art by making it possible to adapt it to different door leaves without requiring the substitution of the elastic means, and conferring substantial uniformity of the opening angle to the door leaves.

Within this aim, an object of the present invention is to provide a hinge that makes it possible to vary its own elastic force in the transitions between the opening and the closing of the same door leaf, again without substitution of the elastic means.

Another object of the invention consists in providing a hinge that is capable of offering the widest guarantees of reliability and safety of use.

Another object of the invention consists in providing a hinge that is easy to implement and economically competitive with the known art.

This aim and these and other objects which will become more apparent hereinafter are all achieved by an adjustable snap-acting hinge, comprising a first articulated quadrilateral and a second articulated quadrilateral, which can move on a working plane and share a first lever and a second lever and are provided respectively with a plate for coupling to a first element and with a plate for fixing to a second element, elastic means being provided with two opposite ends that can move toward or away from each other and operate between a point of the first lever and a contrast element associated with the coupling plate, the hinge being movable alternately between an open configuration and a closed configuration in which the plates have mutually different arrangements, characterized in that the contrast element can be arranged in at least one position for use, which lies between a first position in which the contrast element is arranged at a maximum distance from the point of the first lever and a second position in which the contrast element is arranged at a minimum distance from the point of the first lever in order to vary the preloading of the elastic means, locking means being provided for keeping the contrast element in the position for use.

BRIEF DESCRIPTION OF THE DRAWINGS

Further characteristics and advantages of the invention will become more apparent from the description of two preferred, but not exclusive, embodiments of an adjustable snap-acting hinge, which are illustrated by way of non-limiting example with the assistance of the accompanying drawings wherein.

DETAILED DESCRIPTION

Figure 1:
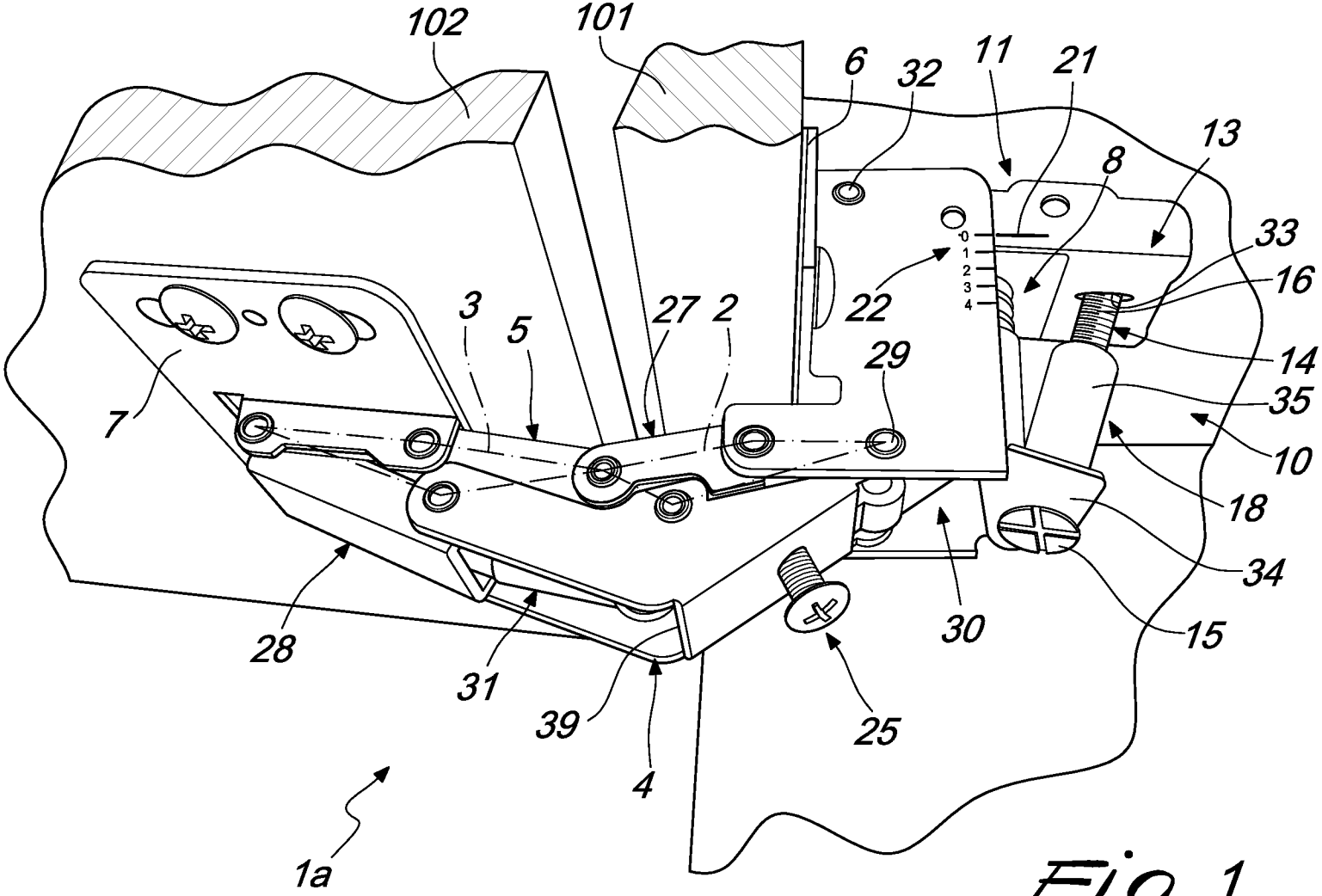
FIG. 1 is a schematic perspective view of a first embodiment of an adjustable snap-acting hinge, according to the invention.
Figure 2:
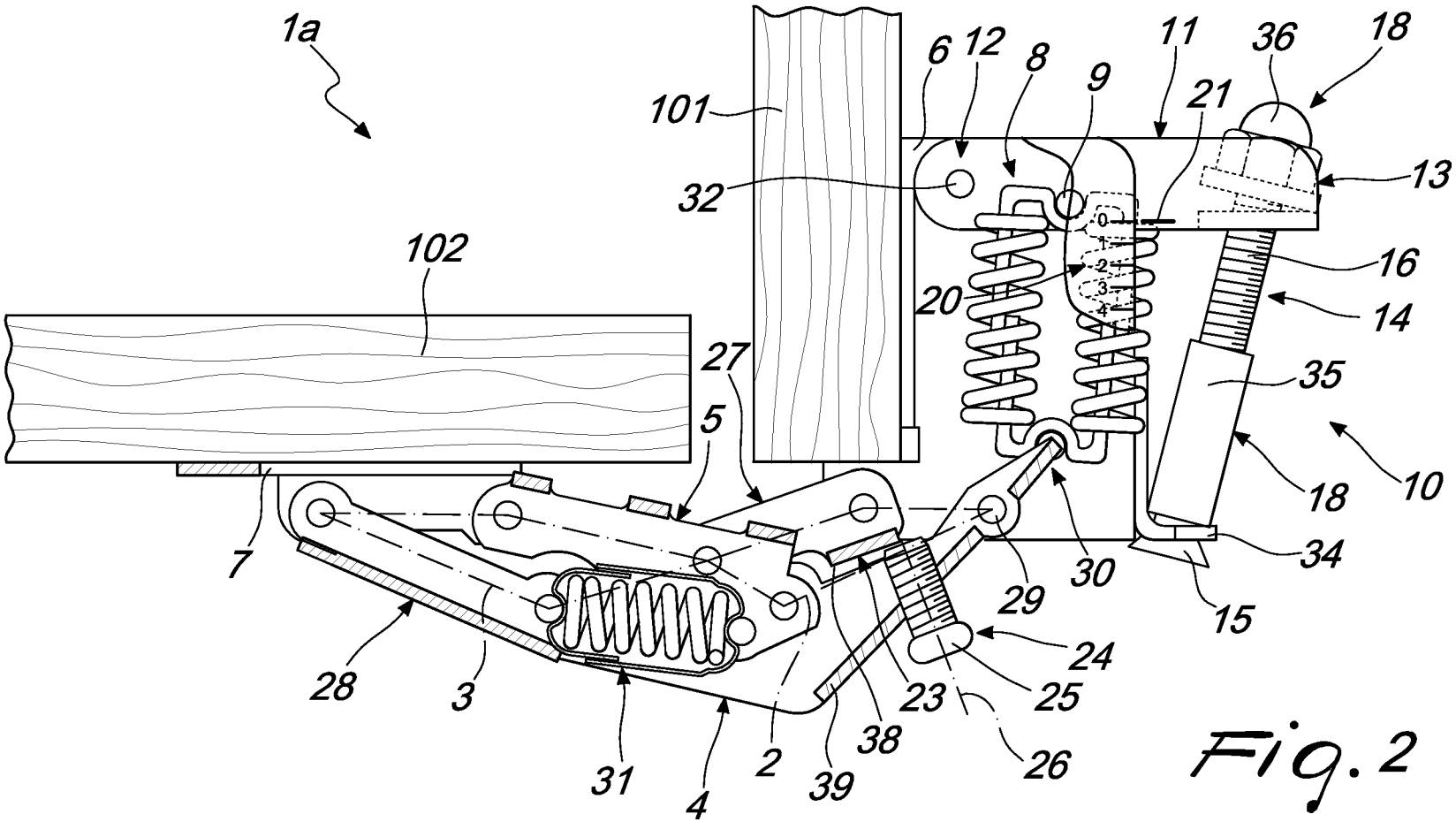
FIG. 2 is a schematic side view, partially sectional, of the hinge in FIG. 1 in the open configuration with a contrast element arranged in a first position.
Figure 3:
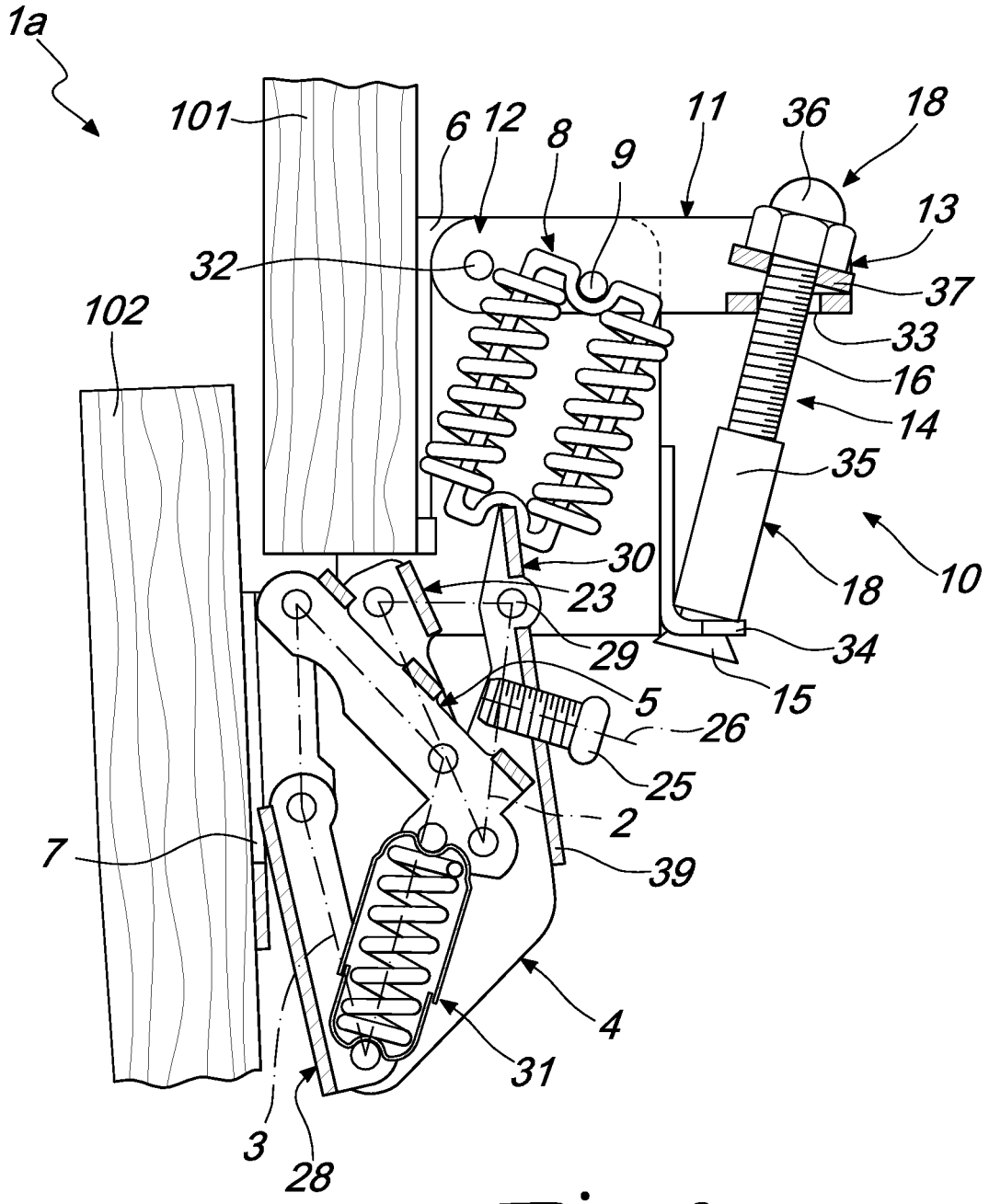
FIG. 3 is a sectional schematic view of the hinge in FIG. 1 in the closed configuration, along a working plane, with a contrast element arranged in a first position.
Figure 4:
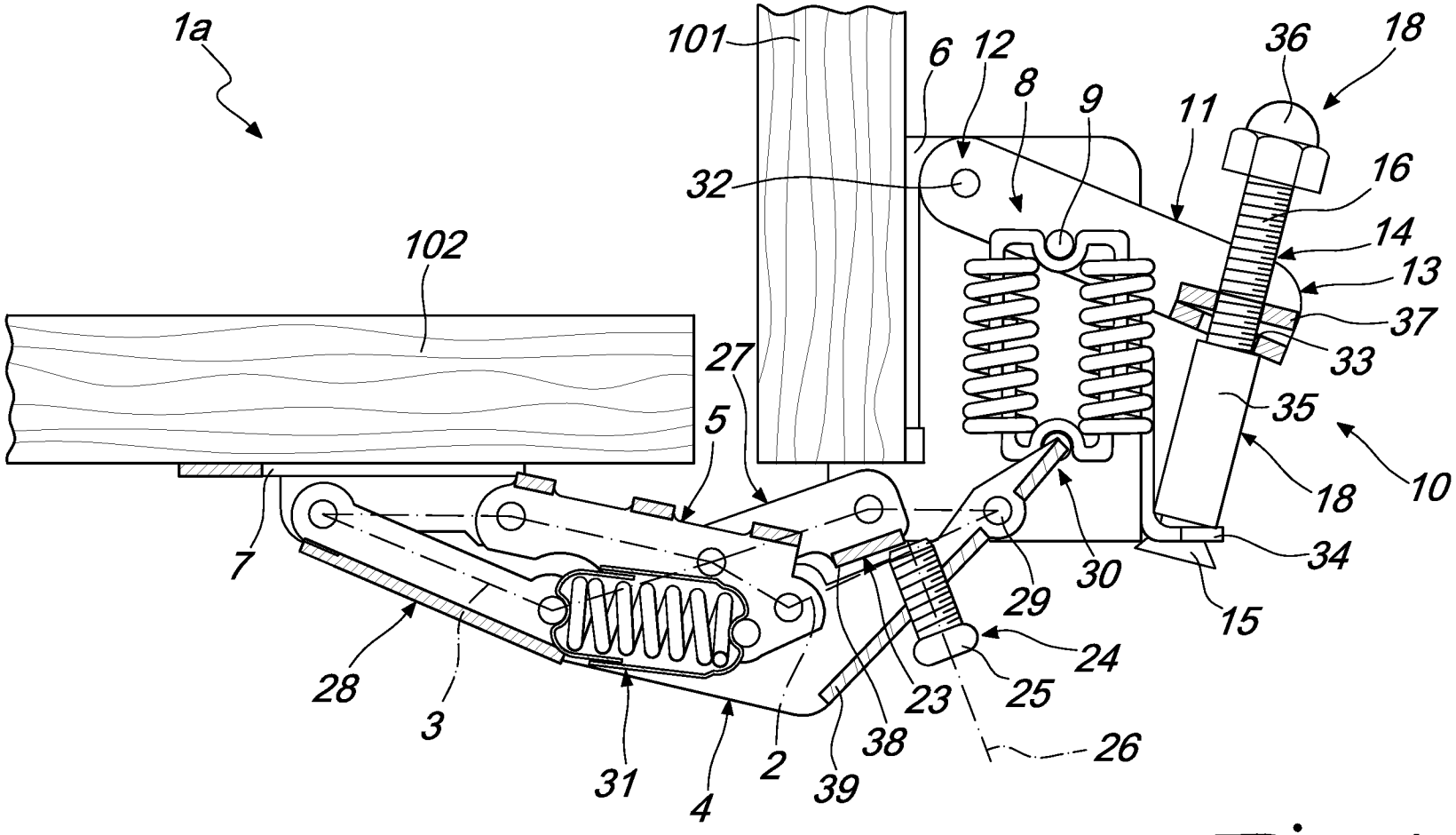
FIGS. 4 and 5 are sectional schematic views of the hinge in FIG. 1, along the working plane, in the open configuration with a contrast element arranged in a first position and with different opening angles between the elements with which the hinge is associated.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

With reference to the figures, the snap-acting hinge, generally designated by the reference numeral 1*a* and 1*b*, comprises a first articulated quadrilateral 2 and a second articulated quadrilateral 3 which can move on a working plane that is normal to the planes of installation of the hinge itself. The quadrilaterals 2 and 3 share a first lever 4 and a second lever 5 and are associated respectively with a plate 6 for coupling to a first element 101 and with a plate 7 for fixing to a second element 102. The hinge 1*a* and 1*b* comprises elastic means 8 provided with two opposite ends that can move toward or away from each other and operate between a point of the first lever 4 and a contrast element 9 associated with the coupling plate 6. The hinge 1*a* and 1*b* is movable alternately between an open configuration and a closed configuration in which the plates 6 and 7 have mutually different arrangements, again on planes that are substantially perpendicular to the working plane.

According to the invention, the contrast element 9 can be arranged in at least one position for use, which lies between a first position in which the contrast element 9 is arranged at a maximum distance from the point of the first lever 4 and a second position in which the contrast element 9 is arranged at a minimum distance from the point of the first lever 4 in order to vary the preloading of the elastic means 8. Conveniently, there are temporary locking means 10 for keeping the contrast element 9 in the position for use.

Such a contrast element 9 is supported by a supporting element 11 that is associated both with the coupling plate 6, and with the locking means 10 and which can move with respect to the coupling plate as a consequence of the adjustment of the locking means 10. In particular, the supporting element 11 has a first flap 12 that is pivoted to the coupling plate 6 about a respective rotation axis that is transverse to the working plane on which the quadrilaterals 2 and 3 can move, and a second flap 13 that is spaced from the first flap 12 and associated with the locking means 10. Interposed between the first flap 12 and the second flap 13 is the contrast element 9, which is integral with the supporting element 11.

Advantageously, the locking means 10 comprise a longitudinal threaded body 14 provided with an end portion 15 that translates integrally along the longitudinal axis of the threaded body with respect to the coupling plate 6 and a stem 16 that is associated, by way of a screw-and-nut coupling, with the second flap 13 for the spacing or approach of the supporting element 11 with respect to the point of the first lever 4. Conveniently, the locking means 10 comprise a stroke limiting element 18 that is associated with the threaded body 14 in order to limit the movement of the contrast element 9 at the first position or at the second position, i.e. in order to allow the movement of the contrast element exclusively between the aforementioned two positions.

Furthermore, the supporting element 11 has at least one reference mark 21 at a graduated scale 22 that is arranged, in turn, on the coupling plate 6 in order to define the exact position of the contrast element 9 in the position for use.

In these particular embodiments, which are illustrated in the accompanying figures, a side of the first quadrilateral 2 is defined between two pivot points of the first lever 4 respectively with the coupling plate 6 and with the second lever 5, while a second side of the first quadrilateral 2, opposite to the first, is defined between two pivot points of a first arm 27 respectively with the coupling plate 6 and with the second lever 5. The second quadrilateral 5 has a first side defined between two pivot points of the second lever 5 respectively with the fixing plate 7 and with the first arm 27, while a second side of the second quadrilateral 3, opposite to the first, is defined between two pivot points of a second arm 28 respectively with the fixing plate 7 and with the first lever 4. The elastic means 8, which are interposed between the point of the first lever 4 and the contrast element 9, comprise a pair of cylindrical compression helical springs. Each one of such springs has an inner supporting core that is formed by two bars which can slide toward or away from each other along the extension of the spring. In other embodiments the elastic means 8 can comprise one or more compression springs. The hinge 1*a* and 1*b* further comprises secondary elastic means 31 which operate between the second arm 28 and the first lever 4 and are protected by two supporting capsules, one slideable inside the other along the longitudinal axis of the corresponding spring, and conveniently contoured to be associated with the respective pivot points.

In the first embodiment, illustrated in FIGS. 1 to 5, the first lever 4 has a tab 30, protruding beyond a first fulcrum 29 that is shared with the coupling plate 6 and lies outside the first quadrilateral 2, the corresponding free end of which defines the point of the first lever 4 which is associated with the elastic means 8. During the transition between the open configuration and the closed configuration of the hinge 1*a*, the tab 30 can move angularly about the axis that passes through the first fulcrum 29 between two end positions in which the elastic means 8 are in two positions of stable equilibrium. In the intermediate positions the elastic means 8 are more compressed owing to the closer approach of the tab 30 to the contrast element 9 and in positions of unstable equilibrium, thus tending to return the hinge 1*a* to the open configuration or to the closed configuration. The contrast element 9 is constituted by a stem that is integral with the supporting element 11 defined by a plate, conveniently contoured, whose first flap 12 is pivoted to the coupling plate 6 through a second fulcrum 32 and whose second flap 13 has a strip provided with a through hole 33 that is crossed by the stem 16. The coupling plate 6 has a protrusion 34, spaced from the second flap 13, in which a slot is provided which accommodates the stem 16. The inner diameter of such slot is greater than the outer diameter of the stem 16 in order to allow the free rotation thereof, but is smaller than the space occupation dimensions of the end portion 15 defined by the head of the threaded body 14 in order to prevent it from passing through. The threaded body 14 has a bush 35 fitted over it which defines a first one of the stroke limiting elements 18. The bush 35 is interposed between the protrusion 34 and the strip of the second flap 13 so as to prevent too close an approach between the second flap and the protrusion 34. The threaded body 14 has a second one of the stroke limiting elements 18 constituted by a grommet nut 36 (or cap nut) locked onto the tip thereof that exits from the through hole 33. Between the through hole 33 and the grommet nut 36 there is an abutment element 37 provided with a threaded hole associated with the threaded body and locked in rotation with respect to the supporting element 11. On the supporting element 11 there is furthermore the reference mark 21 defined by a line, while on the lateral portion of the coupling plate 6, as illustrated in FIG. 1, there is the graduated scale 22.

Furthermore the hinge 1*a*, during the transition between the open configuration, in which the coupling plate 6 and the fixing plate 7 are arranged on planes which are substantially perpendicular to each other, and the closed configuration, in which the coupling plate 6 and the fixing plate 7 are arranged on planes which are substantially parallel to each other, allows the approach or spacing of the first lever 4 with respect to an abutment surface 23 which is associated with another lever of the first quadrilateral 2 or of the second quadrilateral 3. Interposed between the first lever 2 and the abutment surface 23 is at least one shim 24 that, in the open configuration, is arranged in simultaneous contact both with the first lever 2 and with the abutment surface 23 for their mutual spacing. In particular, the shim 24 is an adjustment screw 25 provided with a tip that is adapted to make contact with the abutment surface 23 that is defined by a rib 38 of the first arm 27. The adjustment screw 25, associated by way of screw-and-nut coupling with a shoulder 39 of the first lever 4, can move along a work direction 26 which is transverse with respect to the first lever in order to space its tip from the first lever 4 and allow the consequent spacing of the shoulder 39 from the rib 38 in the open configuration.

Figure 6:
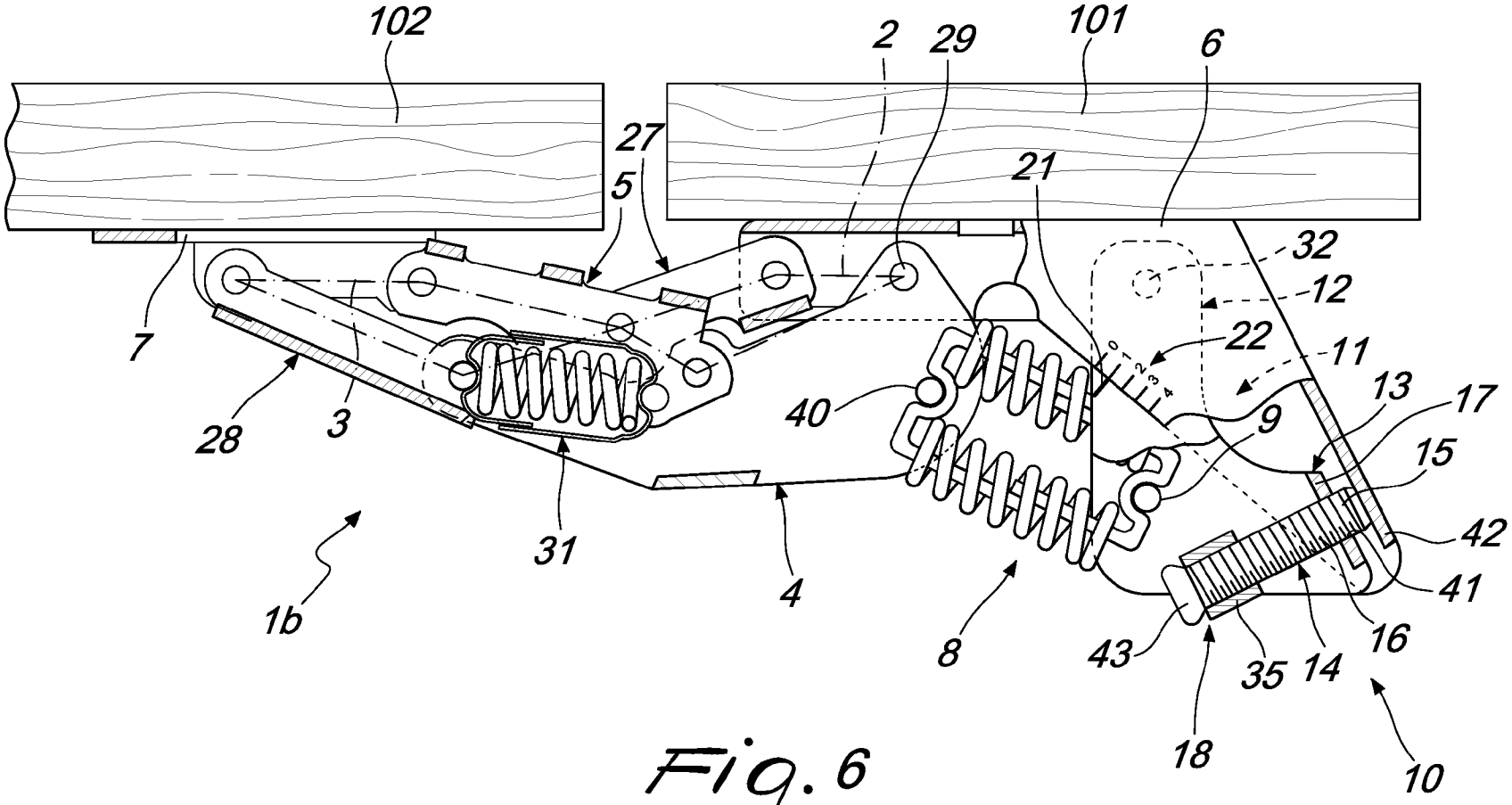
FIG. 6 is a schematic side view, partially sectional, of a second embodiment of an adjustable snap-acting hinge in the open configuration, according to the invention.
Figure 7:
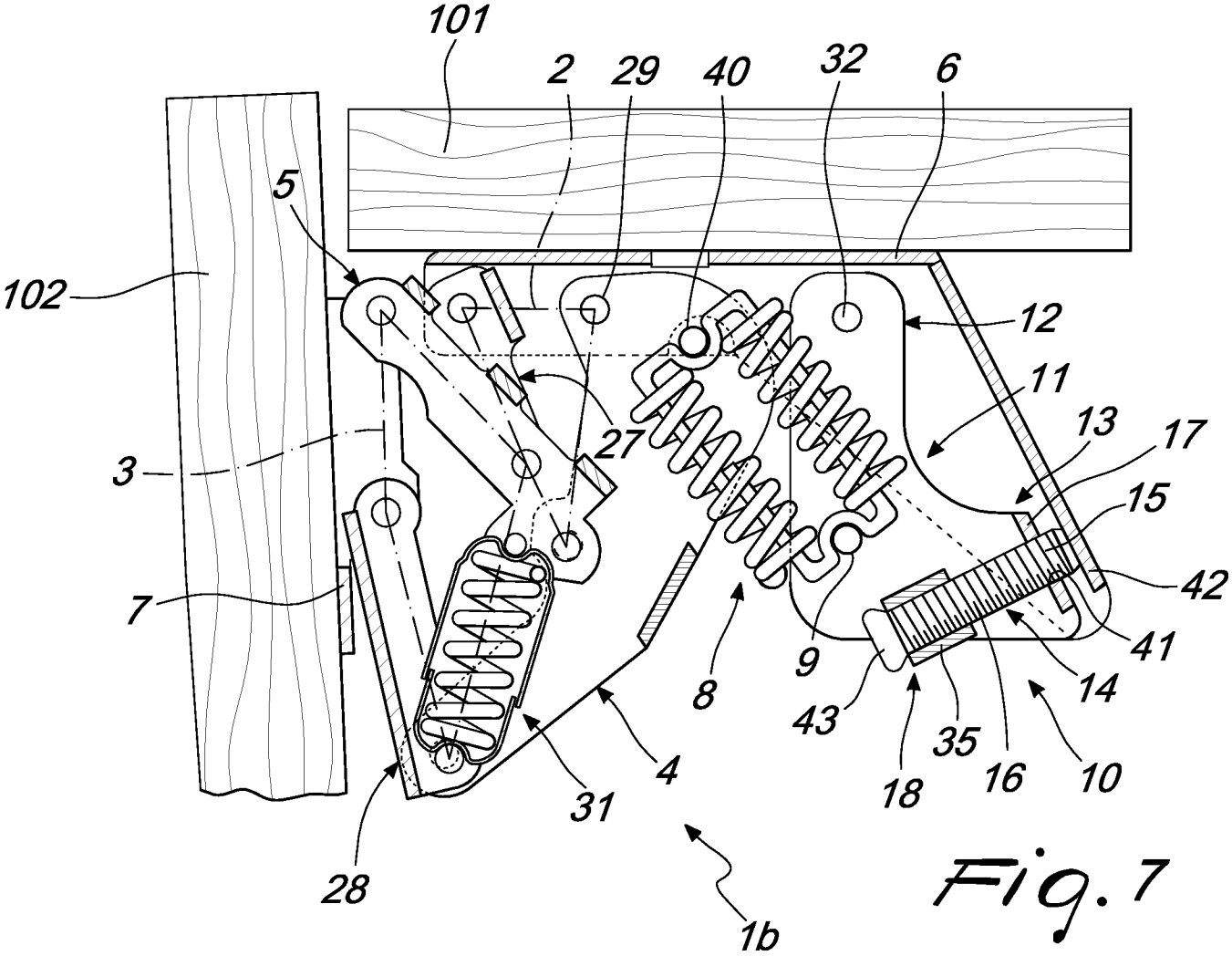
FIG. 7 is a schematic sectional view of the hinge in FIG. 6, along the working plane, in the closed configuration.
Figure 8:
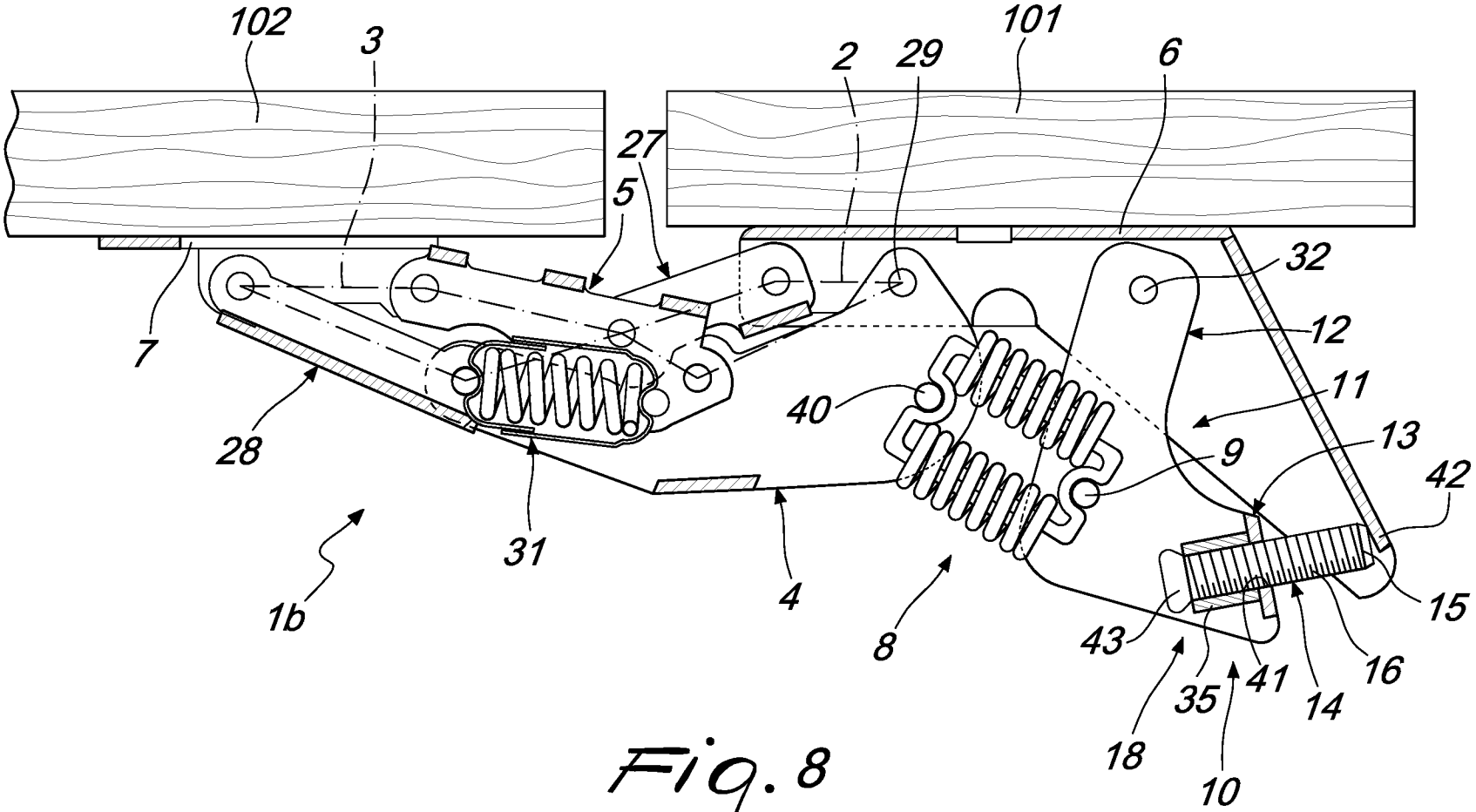
FIG. 8 is a sectional schematic view of the hinge in FIG. 6 in the open configuration, along the working plane, with a contrast element arranged in a second position.

In the second embodiment, illustrated in FIGS. 6 to 8, the first lever 4 of the hinge 1*b* has a dowel 40, arranged outside the first quadrilateral 2, that defines the point of the first lever 4 which is associated with the elastic means 8. Such a dowel 40, which is integral with the first lever 4, during the transition between the open configuration, in which the coupling plate 6 and the fixing plate 7 are arranged on planes which are parallel to each other, and the closed configuration, in which the coupling plate 6 and the fixing plate 7 are arranged on planes which are perpendicular to each other, can move angularly about the axis that passes through the first fulcrum 29 between two end positions in which the elastic means 8 are in two positions of stable equilibrium. As described for the previous embodiment, in this embodiment too the intermediate positions are positions of unstable equilibrium since the elastic means 8, which are more compressed owing to the approach of the dowel 40 to the contrast element 9, tend to return the hinge 1*b* to the open configuration or to the closed configuration. The contrast element 9 is constituted by a stem that is integral with the supporting element 11 that is defined by a plate, conveniently contoured, whose first flap 12 is pivoted to the coupling plate 6 through a second fulcrum 32. The second flap 13 has a plate 17 that is provided with a threaded hole 41 to which the stem 16 of the threaded body 14 is coupled by way of threading. The end portion 15 of the threaded body 14, formed by the tip of the threaded body itself, is in abutment against an abutment wall 42 that is integral with the coupling plate 6. At the opposite end of the threaded body 14, which is defined by a screw, there is a head 43 through which it is possible to rotate the threaded body in order to allow the spacing or approach of the plate 17 with respect to the abutment wall 42, i.e. make it possible to lock the contrast element 9 in a position for use. Advantageously, the threaded body 14 has a bush 35 fitted over it which defines the stroke limiting element 18. Such a bush 35 is interposed between the head 43 and the plate 17, thus limiting the second position of the contrast element 9. Similarly to the first embodiment, the hinge 1*b* also has a reference mark 21 defined by a line on the supporting element 11, while on the lateral portion of the coupling plate 6 there is the graduated scale 22.

Operation of the adjustable snap-acting hinge 1*a* and 1*b* is described below.

Figure 5:
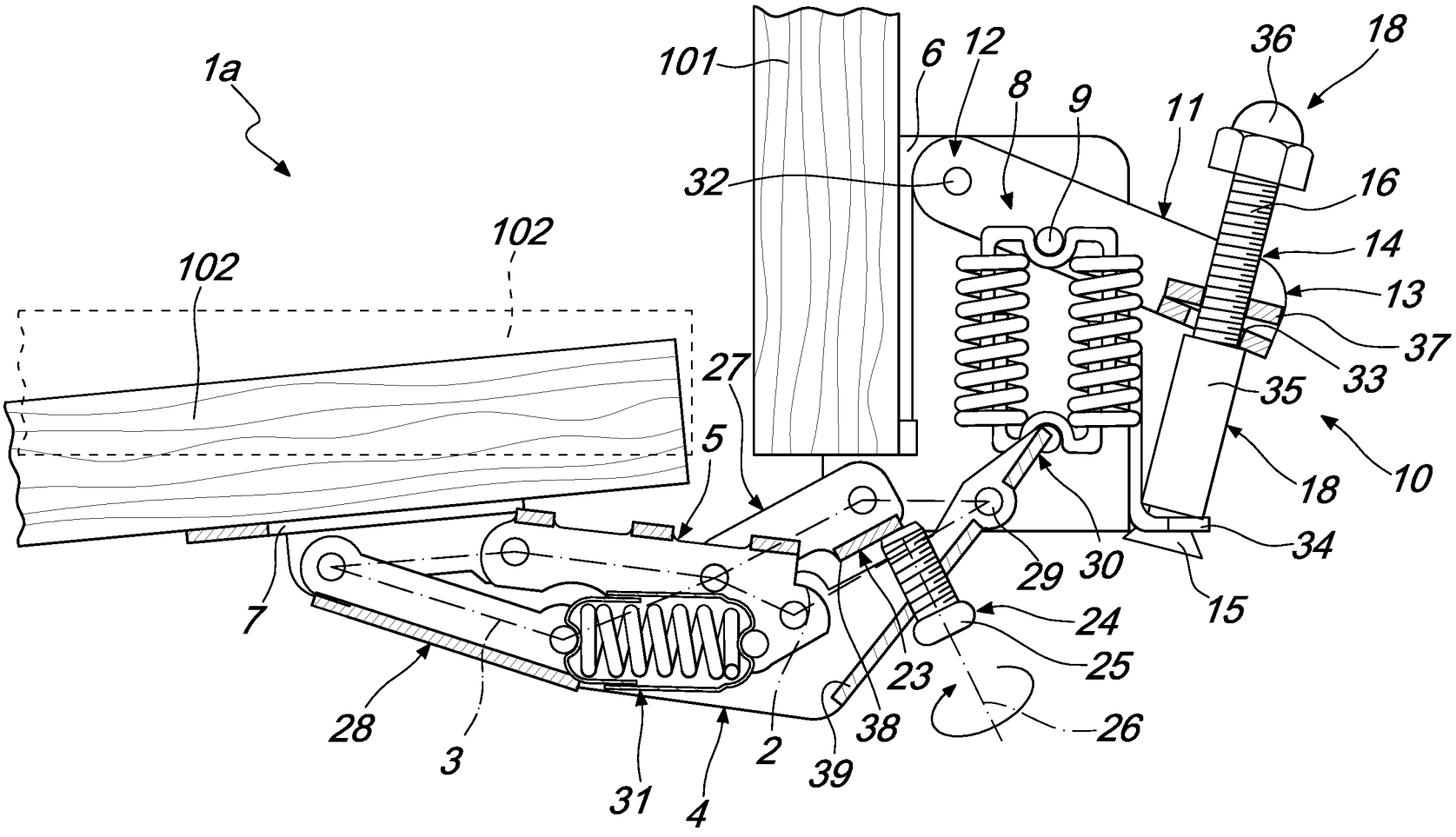

In the first embodiment, varying the preloading of the elastic means 8 occurs by rotating the threaded body 14. Rotating the latter, which is free to rotate in the slot defined in the protrusion 34, allows the movement of the abutment element 37 with which it is associated by threading. According to the direction of rotation of the threaded body 14, the abutment element 37 is moved axially along the longitudinal axis of the threaded element, moving the contrast element 9 toward the second or first position, compressing or relaxing the elastic means 8. The movement toward the first position is limited by the grommet nut 36 which prevents the abutment element 37 from being moved further away, whereas the movement toward the second position is limited by the bush 35 which, by being arranged between the second flap 13 and the protrusion 34, prevents the abutment element 37 from being moved closer. The movement of the contrast element 9 into the position for use can be precisely noted by reading the position of the reference mark 21 with respect to the graduated scale 22. In this manner the operator, by noting the exact position of the reference mark 21, can adjust the preloading of the hinges 1*a* precisely. For elements 102, i.e. a door leaf, of higher weight, it is sufficient to move the contrast element 9 towards the second position, thus increasing the compression of the elastic means 8 so as to have a higher preloading. Increasing the preloading makes it possible to react elastically with higher force to the movement of the element 102 and to its being left in the open configuration. Vice versa, for elements 102 of lesser weight, it is sufficient to move the contrast element 9 toward the first position, thus relaxing the preloading of the elastic means 8. In the hinge 1*a* it is furthermore possible to adjust the opening angle of the element 102 with respect to the element 101 by adjusting the adjustment screw 25. In particular, rotating the adjustment screw 25 makes it possible to move it along the direction 26, spacing the tip of the adjustment screw from the shoulder 39 to a greater or lesser extent. The larger the distance of the tip from the shoulder 39, the larger the consequent angle that is formed between the two opposite sides of the first quadrilateral 2 which are defined along the first arm 27 and the first lever 4, because they cannot come any closer due to the presence of the adjustment screw 25. In the open configuration, a larger angle defined between opposite sides of the first quadrilateral 2 reduces the opening angle of the element 102 with respect to the element 101, as illustrated in FIG. 5. Vice versa, retracting the tip of the adjustment screw 25 makes it possible to flatten the first quadrilateral 2 and obtain a larger opening angle of the element 102 with than of the element 101.

In the second embodiment, similarly to the previous one, varying the preloading of the elastic means 8 occurs by rotating the threaded body 14. Rotating the latter enables the movement of the plate 17 in which the threaded hole 41 (with which the threaded body is associated) is defined, with respect to the abutment wall 42. According to the direction of rotation of the threaded body 14, the second flap 13, which is integral with the plate 17, is moved angularly about the rotation axis that passes through the second fulcrum 32, also angularly moving the contrast element 9 with respect to that axis toward the second or first position, compressing or relaxing the elastic means 8, as described previously in the first embodiment. The movement toward the first position is limited by the abutment wall 42 which prevents the second flap 13 from being moved further away, whereas the movement toward the second position is limited by the bush 35 which, by being arranged between the second flap 13 and the head 43, prevents the second flap from being moved closer. The movement of the contrast element 9 into the position for use can be precisely noted by reading the position of the reference mark 21 with respect to the graduated scale 22. In this manner the operator, by noting the exact position of the reference mark 21, can adjust the preloading of the hinges 1*b* precisely.

In practice it has been found that the adjustable snap-acting hinge, according to the present invention, achieves the intended aim and objects in that it makes it possible to adapt it to different door leaves with different weights without requiring a suitable dimensioning of the elastic means, and conferring a substantial uniformity of the opening angle and in the transition between opening and closing of the door leaf. In fact, thanks to the adjustment of the preloading of the elastic means, the same hinge with the same elastic means can vary the elastic force of reaction as a function of the weight of the door leaf to be opened/closed and to be kept in the open configuration, thus mutually standardizing the various door leaves that are present in the caravan. Furthermore, thanks to the presence of a graduated scale, visible to the operator, it is possible to vary the preloading of the spring of the hinge with precision.

Another advantage of the hinge, according to the invention, consists in being able to adjust the elastic force of the elastic means of just one door leaf without requiring the substitution of the elastic means. In fact, the adjustment of the position for use by way of the temporary locking means makes it possible to vary at will the opening/closing transition or the position in which a single door leaf can be left open.

Another advantage of the hinge, according to the invention, consists in being able to adjust the opening angle of the door leaf with respect to the cabinet, preventing the door leaf in the open configuration from directly striking the ceiling of the camper van, or elements applied to the ceiling, or other elements arranged at a level higher than the top of the cabinet. In fact, thanks to the adjustment of the adjustment screw it is possible to limit the opening of a first one of the quadrilaterals (and consequently also of the second quadrilateral), thus limiting the total opening angle of the door leaf with respect to the cabinet. Such adjustment also prevents collisions of handles, if particularly bulky, of the door leaf against elements that are arranged at a level higher than the top of the cabinet.

Another advantage of the hinge, according to the invention, consists in that it can be applied on any door leaf and corresponding cabinet with planes of arrangement that are parallel or perpendicular in the open configuration and/or in the closed position.

The adjustable snap-acting hinge thus conceived is susceptible of numerous modifications and variations all of which are within the scope of the appended claims.

Moreover, all the details may be substituted by other, technically equivalent elements.

In practice the materials employed, provided they are compatible with the specific use, and the contingent dimensions and shapes, may be any according to requirements.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hinge for moving a first element and a second element with respect to each other, the hinge comprising:

a first articulated quadrilateral and a second articulated quadrilateral each defined by pivot points that pivot on a working plane, wherein the first and second articulated quadrilaterals share a first lever and a second lever;

a coupling plate connected to the first element and the first articulated quadrilateral; and a fixing plate connected to the second element and the second articulated quadrilateral, wherein the fixing plate and the coupling plate are moveable with respect to each other between an open configuration and a closed configuration;

a supporting element pivotally connected to the coupling plate at a fulcrum with a rotation axis transverse to the working plane and separate from the pivot points of the first and second articulated quadrilaterals;

an elastic means being provided with two opposite ends that can move toward or away from each other and act between a point of the first lever and a contrast element positioned on the supporting element; and a locking means connected to the supporting element to vary a distance of the contrast element from the point of the first lever and thereby set a preloaded compression of the elastic means, wherein the supporting element moves with respect to the coupling plate following the adjustment of the locking means, and wherein adjusting the locking means does not adjust an opening angle between the first and second element.

2. The hinge according to claim 1, wherein the coupling plate is connected to at least two pivot points on the first articulated quadrilateral each separate from the fulcrum of the supporting element.

3. The hinge according to claim 1, wherein the supporting element is pivotally connected to the coupling plate at a first end and the locking means is connected to the supporting element at a second end opposite the first end.

4. The hinge according to claim 3, wherein the contrast element is connected to the supporting element in a central position between the first end and the second end.

5. The hinge according to claim 3, wherein the locking means comprise a threaded body provided with an end portion that translates with respect to the coupling plate and a stem that is engaged with the supporting element to adjust the spacing between the contrast element and the point of the first lever.

6. The hinge according to claim 5, further comprising a stroke limiting element that is associated with the threaded body to limit the movement of the contrast element at the first position or the second position.

7. The hinge according to claim 1, wherein the supporting element has at least one reference mark and the coupling plate has a graduated scale, wherein the reference mark is moved with adjustment of the locking means in order to align with a position on the graduated scale and move the contrast element thereby fixing the preloaded compression setting at a predetermined setting.

8. An adjustable hinge comprising:

a first articulated quadrilateral and a second articulated quadrilateral each defined by pivot points that pivot on a working plane and share a pivot point on a first lever;

a coupling plate connected to the first articulated quadrilateral;

a fixing plate connected to the second articulated quadrilateral and moveable with respect to the coupling plate, wherein at least one of the fixing plate and the coupling plate are moveable between a specified open configuration and a closed configuration;

a supporting element pivotally connected to the coupling plate at a fulrum having a rotation axis transverse to the working plane and separate from the pivot points of the first and second articulated quadrilaterals;

an elastic means connected between a point of the first lever and a contrast element positioned on the supporting element, a locking means connected to the supporting element, wherein adjustment of the locking means pivots the supporting element with respect to the coupling plate and moves the contrast element relative the point of the first lever, thereby adjusting a preloaded compression of the elastic means without adjusting an opening angle between the coupling plate and the fixing plate in the open configuration, wherein the preloaded compression biases the hinge to at least one of stable open configuration and the closed configuration.

9. The hinge according to claim 8, wherein the coupling plate is connected to at least two pivot points on the first articulated quadrilateral each separate from the fulcrum of the supporting element.

10. The hinge according to claim 8, wherein the supporting element has at least one reference mark and the coupling plate has a graduated scale, wherein the reference mark is moved with adjustment of the locking means to align with a position on the graduated scale and move in order to define the preloaded compression.

11. The hinge according to claim 8, wherein the locking means comprises a threaded body provided that translates relative to the coupling plate to adjust a distance between the contrast element and the point of the first lever.

12. The hinge according to claim 11, further comprising a stroke limiting element operatively connected to the threaded body to limit the distance between the contrast element and the point on the first lever.

13. An adjustable hinge for connecting to at least one door leaf to bias the door leaf to at least one of a stable open configuration and a stable closed configuration, the hinge comprising:

a linkage having at least four lever arms pivotally connected;

a first articulated quadrilateral and a second articulated quadrilateral each defined by pivot points of the linkage and sharing at least one pivot point on a first lever, the first and second articulated quadrilateral pivot on a working plane;

a coupling plate connected to at least two pivot points on the first articulated quadrilateral;

a fixing plate connected to at least two pivot points on the second articulated quadrilateral and moveable with respect to the coupling plate, wherein at least one of the fixing plate and the coupling plate are adapted for connecting to the door leaf and are moveable between the stable open configuration and the closed configuration;

a supporting element pivotally connected to the coupling plate at a third pivot point separate from the pivot points of the first and second articulated quadrilaterals;

a compression spring connected between a point of the first lever and a contrast element on the supporting element; and a threaded body connected to the supporting element, wherein rotation of the threaded body translates the threaded body relative to the coupling plate to adjust a distance between the contrast element and the point of the first lever and set a preloaded compression of the compression spring without adjusting an opening angle between the coupling plate and the fixing plate, wherein the preloaded compression biases the door leaf to at least one of the stable open configuration and stable closed configuration.

14. The hinge according to claim 13, wherein the supporting element has at least one reference mark and the coupling plate has a graduated scale, wherein the reference mark is moved with adjustment of the threaded body in order to define the preloaded compression.

15. The hinge according to claim 14, further comprising a stroke limiting element operatively connected to the threaded body to limit the distance between the contrast element and the point on the first lever.

16. The hinge of claim 13 wherein the preloaded compression is adjustable based on a weight of the door leaf.

* * * * *